United States Patent [19]

Henville

[11] 4,348,563

[45] Sep. 7, 1982

[54] SNAP ACTION SWITCHES

[75] Inventor: Michael I. Henville, Maidenhead, England

[73] Assignee: Unimax Switch Limited, Maidenhead, England

[21] Appl. No.: 182,222

[22] Filed: Aug. 28, 1980

[30] Foreign Application Priority Data

Aug. 31, 1979 [GB] United Kingdom ..... 7930347

[51] Int. Cl.[3] ..... H01H 13/38

[52] U.S. Cl. ..... 200/67 D

[58] Field of Search ..... 200/67 R, 67 A, 67 B, 200/67 C, 67 D, 67 DA, 67 DB, 67 E, 67 PK, 159 R; 74/100 P

[56] References Cited

U.S. PATENT DOCUMENTS 3,033,953 5/1962 Schwerke ..... 200/67 D 3,539,742 11/1970 Wilkes ..... 200/67 DA

FOREIGN PATENT DOCUMENTS 1132863 11/1968 United Kingdom ..... 200/67 D

*Primary Examiner*—Stephen Marcus

*Attorney, Agent, or Firm*—Bernard Malina

[57] ABSTRACT

A micro-switch has an auxiliary return spring in the form of a hairpin spring acting directly on the actuating button through a hole in the contact carrier to increase the return force on whatever external means engage the button, but without affecting the behavior of the contact carrier. The use of a hairpin spring allows it to be accommodated within an existing standard switch body without upsetting the placing of standard mounting holes.

1 Claim, 1 Drawing Figure

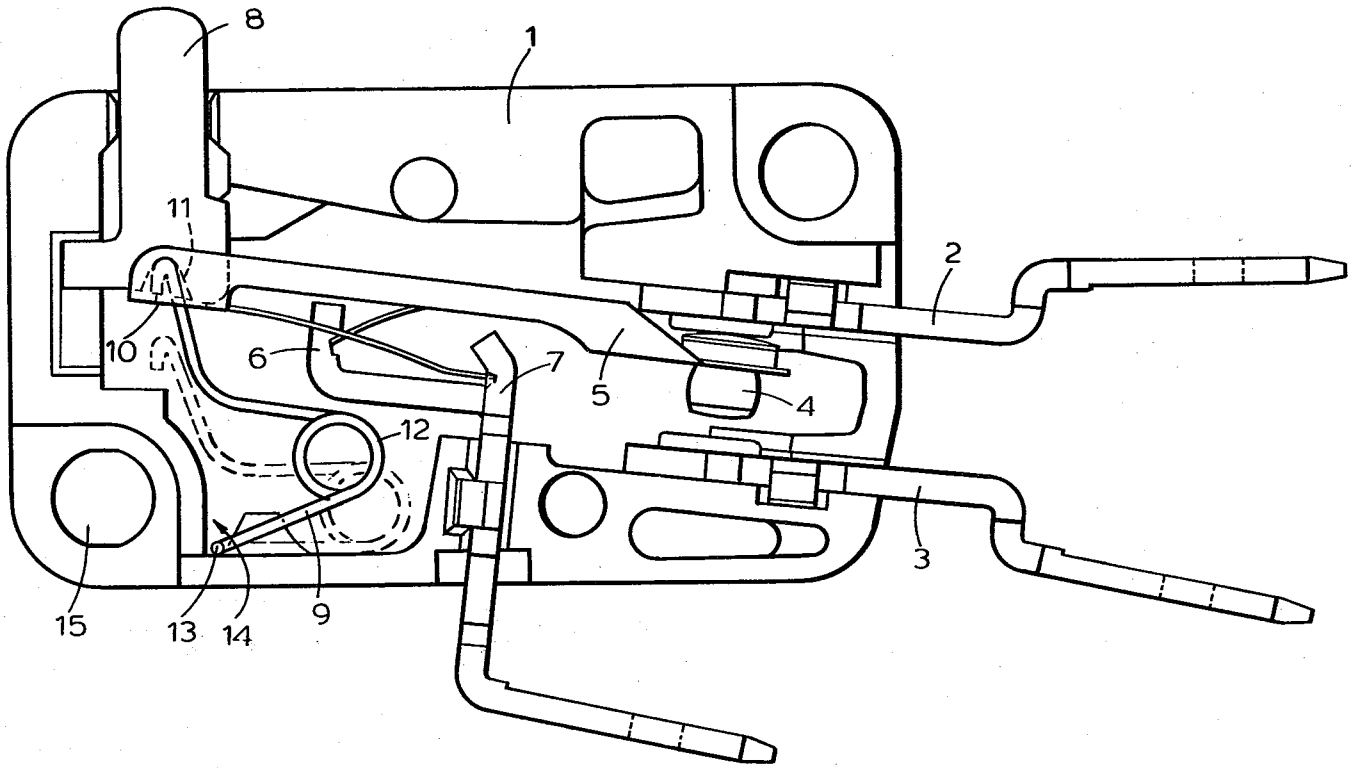
1
2
3
4
5
6
7
8
9
10
11
12
13
14
15

SNAP ACTION SWITCHES

BACKGROUND OF THE INVENTION

This invention relates to miniature snap-action switches, often known as micro-switches. Such switches usually employ an actuating member such as a button, which requires a low force to actuate it. Indeed, it is usually considered desirable to keep the actuating force as low as possible, consistent with adequate contact pressures being obtained within the switch. However, in some situations the restoring force produced by the switch itself is employed to return to its starting position the external element that acts on the switch; in such a case a high actuating force is desirable.

It would be possible to achieve this by increasing the strength of the snap action spring of the switch but, because it is a highly stressed component, this may reduce the mechanical life of the switch to an unacceptable level.

The introduction of compression springs under the end of the carrier, below the button, is a known method of dealing with this problem, but has several disadvantages. Because of its finite diameter, a compression spring acting against the carrier can exert a moment of force which changes the operating characteristics of the snap-action. To accommodate a compression spring of suitable rate, a deep, clear, space is required directly under the point of contact of the button and carrier. This is not available in most switches of this type due to the obstruction of mandatory standard mounting holes, one of which passes through the switch in this area. Compression springs, because of their open coils, are difficult to assemble by automatic means.

BRIEF DESCRIPTION OF THE INVENTION

According to the invention, therefore, the additional force is provided by a hairpin type of spring, the shape of which can be arranged to suit the space limitations. Preferably it acts directly on the button. One leg of it may pass through a hole in the carrier to be located in a recess formed in the end of the button. An appropriate groove can be provided in the moulded casing of the switch to locate the other end of the spring. The force which this spring applies to the button in no way effects the snap-acting mechanism, or the electrical characteristics, or the mechanical life of the switch.

Further objects, features and advantages of the invention will become apparent from a consideration of the following description, the appended claims and accompanying drawing in which:

BRIEF DESCRIPTION OF THE DRAWINGS

The drawing is an elevation view of a snap action switch in accordance with the principles of the present invention with one half of the casing removed.

DETAILED DESCRIPTION OF THE INVENTION

An example of a switch embodying the invention is illustrated in the accompanying drawings, which shows the switch with one half of its casing removed. It is of basically known construction, comprising a casing 1 having fixed contacts 2 and 3 engaged by a moving contact 4 mounted on a contact carrier in the form of a spring 5 engaging opposed abutments 6 and 7. An actuating button 8 is mounted to slide in the casing and engages the free end of the contact carrier 5. The spring according to the invention is shown at 9 and is in the form of a hairpin spring of bent wire, of a kind also known as a torsion spring, with one leg passing through a clearance hole 10 in the contact carrier 5 and received in a recess 11 in the button 8. The spring has one or more turns 12 at its bight and its other end 13 is received in a suitably formed groove 14 in the moulded casing 1. The spring 9 acts directly on the button 8, urging it to its rest position and providing a high restoring force. At the same time, unlike a coil spring acting on the contact carrier 5, it does not upset the behaviour of the contact carrier and it does not interfere with the positioning of a mounting hole 15 in the adjacent corner of the casing 1.

While a preferred embodiment of the invention has been described herein, it is obvious that numerous omissions, changes and additions may be made in such embodiment without departing from the spirit and scope of the invention.

I claim:

1. A snap-action micro-switch comprising:

a casing having a plurality of mounting holes formed therein at preselected locations;

a fixed contact mounted within said casing;

An over-center snap action spring-loaded contact carrier mounting a movable contact and movable within said casing between a normal rest position occupied in the absence of an externally applied force and an operative position, said fixed contact being engaged by said movable contact in the rest position of said carrier;

an actuating button having first and second ends and guided for linear sliding movement within said casing;

said first end of said actuating button projecting outwards of said casing and said second end of said button engaging said carrier at a point displaced from said movable contact for movement of said carrier from said rest position to said operative position on inward sliding movement of said button in an actuating direction relative to said casing, said movement being effectable against the spring force of said spring-loaded carrier; and auxiliary spring means acting on said actuating button comprising a hairpin spring located wholly within said casing on the opposite side of said carrier from said button and clear of said mounting holes and having first and second limbs;

said first limb of said hairpin spring being located in a recess in said casing and said second limb of said hairpin spring engaging directly said second end of said actuating button, said hairpin spring being free of any contact with said contact carrier and being stressed such as to apply a force urging said button outwards of the casing.

* * * * *